US009769889B2

(12) United States Patent
Jiang et al.

(10) Patent No.: US 9,769,889 B2
(45) Date of Patent: Sep. 19, 2017

(54) DRIVING CIRCUIT FOR FLASH LIGHT-EMITTING DIODE AND OPERATING METHOD THEREOF

(71) Applicant: ASUSTeK COMPUTER INC., Taipei (TW)

(72) Inventors: Tao Jiang, Taipei (TW); Xiaofeng Zhou, Taipei (TW); Ching-Ji Liang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 15/183,796

(22) Filed: Jun. 16, 2016

(65) Prior Publication Data

US 2016/0374163 A1 Dec. 22, 2016

(30) Foreign Application Priority Data

Jun. 16, 2015 (CN) ..... 2015 1 0333241

(51) Int. Cl.
*G05F 1/00* (2006.01)
*H05B 37/02* (2006.01)
*H05B 33/08* (2006.01)

(52) U.S. Cl.
CPC ..... *H05B 33/0815* (2013.01); *H05B 33/0842* (2013.01)

(58) Field of Classification Search
CPC ..... H05B 33/0815; H05B 33/0842; H02M 3/1582
USPC ..... 315/297; 323/282, 284
See application file for complete search history.

(56) References Cited

U.S. PATENT DOCUMENTS

2005/0093526 A1* 5/2005 Notman ..... H02M 3/1582 323/282
2009/0108823 A1* 4/2009 Ho ..... H02M 3/1582 323/282
2011/0140619 A1* 6/2011 Lin ..... H02M 3/158 315/193
2015/0162835 A1* 6/2015 Hang ..... H02M 3/1582 323/271

FOREIGN PATENT DOCUMENTS

CN 103595842 2/2014
CN 203608406 5/2014

* cited by examiner

*Primary Examiner* — Daniel D Chang
(74) *Attorney, Agent, or Firm* — Jianq Chyun IP Office

(57) ABSTRACT

A driving circuit for providing a driving voltage to a first flash light-emitting diode is provided. The driving circuit includes an inductor, a first switch, a second switch, a capacitor, a third switch, a fourth switch and a control unit. The control unit controls operating modes of the inductor and the capacitor to a boost mode or a buck mode according to a driving mode of the first flash light-emitting diode, and determines whether to switch the operating modes of the inductor and the capacitor according to a first driving current flowing through the first flash light-emitting diode. An operating method for the driving circuit is also provided.

13 Claims, 4 Drawing Sheets

DRIVING CIRCUIT FOR FLASH LIGHT-EMITTING DIODE AND OPERATING METHOD THEREOF

CROSS-REFERENCE TO RELATED APPLICATION

This application claims the priority benefit of China application serial No. 201510333241.2, filed on Jun. 16, 2015. The entirety of the above-mentioned patent application is hereby incorporated by references herein and made a part of specification.

BACKGROUND OF THE INVENTION

Field of the Invention

The invention relates to a driving circuit and, more specifically, to a driving circuit for a flash light-emitting diode and an operating method thereof.

Description of the Related Art

Photoflash is usually configured into a smart phone. Flash light-emitting diodes are popular due to low power consumption.

Conventionally, forward voltage of driving circuits for the flash light-emitting diodes are different along with different currents flowing through the flash light-emitting diodes, and thus whether the driving circuit is in a linear buck mode or a boost mode can be determined by comparing an input voltage with an output voltage. However, the poor efficiency of the linear buck mode lowers the whole efficiency of the driving circuit.

BRIEF SUMMARY OF THE INVENTION

According to one aspect, a driving circuit for providing a driving voltage to a first flash light-emitting diode is provided. The driving circuit includes an inductor, a first switch, a second switch, a capacitor, a third switch, a fourth switch and a control unit.

The first switch is coupled between an input voltage and a first end of the inductor. The second switch is coupled between the first end of the inductor and a ground voltage. A first end of the capacitor provides the driving voltage and a second end of the capacitor is coupled to the ground voltage. The third switch is coupled between a second end of the inductor and the first end of the capacitor. The fourth switch is coupled between the second end of the inductor and the ground voltage.

The control unit is coupled to the first switch, the second switch, the third switch and the fourth switch. The control unit controls the inductor and the capacitor to operate at a boost mode or a buck mode according to a driving mode of the first flash light-emitting diode, and determines whether to switch the operating modes of the inductor and the capacitor according to a first driving current flowing through the first flash light-emitting diode.

According to another aspect, an operating method of a driving circuit for driving a first flash light-emitting diode is provided. The driving circuit includes an inductor and a capacitor. The operating method comprises: determining a driving mode of a first flash light-emitting diode, controlling operating modes of the inductor and the capacitor according to the driving mode of the first flash light-emitting diode, and determining whether to switch the operating modes of the inductor and the capacitor according to a first driving current flowing through the first flash light-emitting diode.

In sum, in embodiments, the inductor and the capacitor are controlled to serve as a buck circuit or a boost circuit. Whether to switch the operating modes of the inductor and the capacitor is determined according to the driving current flowing through the flash light-emitting diode. In such a way, the driving circuit is improved due to the high efficient buck circuit.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Figure 1:
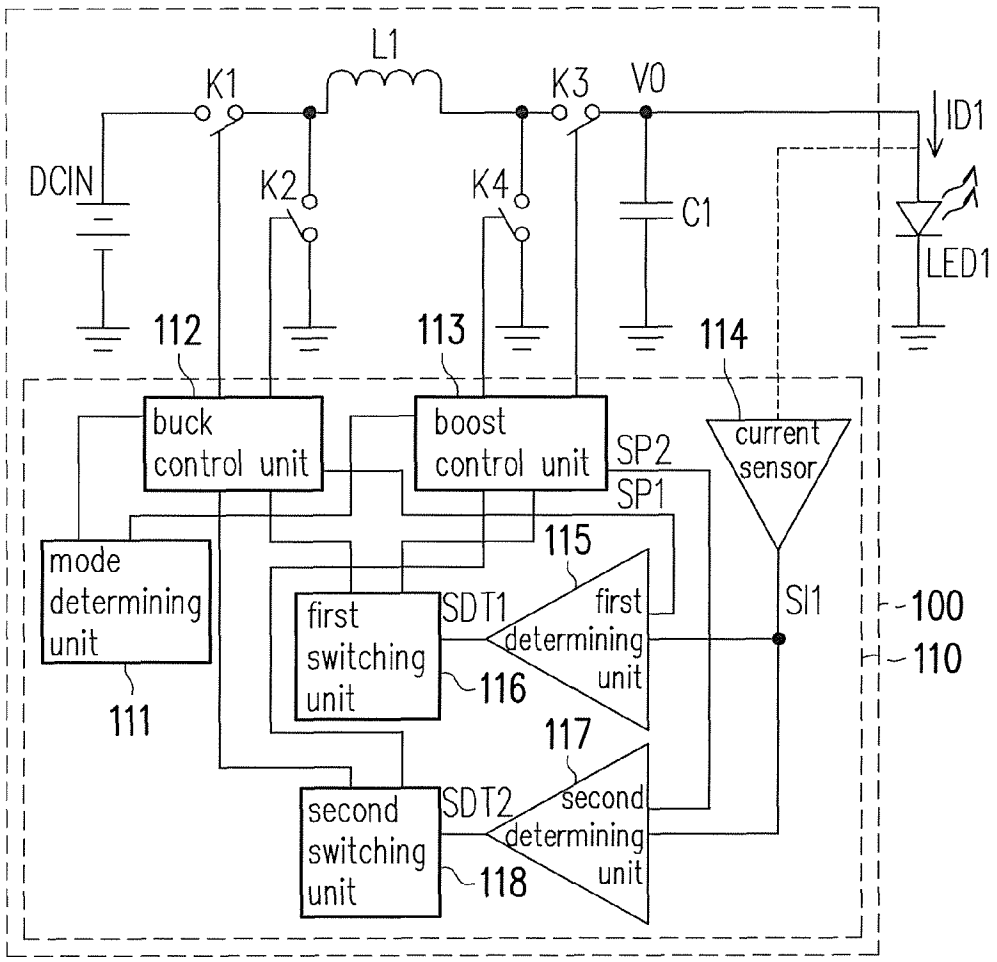
FIG. 1 is a circuit schematic diagram showing a driving circuit for a flash light-emitting diode in an embodiment.

FIG. 1 is a circuit schematic diagram showing a driving circuit for a flash light-emitting diode in an embodiment. Referring to FIG. 1, in the embodiment, a driving circuit 100 for a flash light-emitting diode provides a driving voltage VO to a flash light-emitting diode LED1 (corresponding to a first flash light-emitting diode). The driving circuit 100 includes a first switch K1, a second switch K2, an inductor L1, a third switch K3, a fourth switch K4, a capacitor C1 and a control unit 110.

The first switch K1 is coupled between an input voltage DCIN and a first end of the inductor L1. The second switch K2 is coupled between the first end of the inductor L1 and a ground voltage. The third switch K3 is coupled between a second end of the inductor L1 and a first end of the capacitor C1. The fourth switch K4 is coupled between the second end of the inductor L1 and the ground voltage. The first end of the capacitor C1 provides the driving voltage VO, and a second end of the capacitor C1 is coupled to the ground voltage.

The control unit 110 is coupled to the first switch K1, the second switch K2, the third switch K3 and the fourth switch K4. The control unit 110 controls the inductor L1 and the capacitor C1 to operate at a boost mode or a buck mode according to a driving mode of the flash light-emitting diode LED1. In an embodiment, when the driving mode of the flash light-emitting diode LED1 is a torch mode (that is, the flash light-emitting diode LED1 is driven by a low current), the control unit 110 controls the inductor L1 and the capacitor C1 to operate as the buck circuit via the on/off the first switch K1, the second switch K2, the third switch K3 and the fourth switch K4. When the driving mode of the flash light-emitting diode LED1 is a flash mode (that is, the flash light-emitting diode LED1 is driven by a large current), the control unit 110 controls the inductor L1 and the capacitor C1 to operate as the boost circuit via on/off the first switch K1, the second switch K2, the third switch K3 and the fourth switch K4.

In the embodiment, the control unit 110 detects a first driving current ID1 flowing through the flash light-emitting diode LED1 and determines whether to switch the operating modes of the inductor L1 and the capacitor C1 according to the first driving current ID1 flowing through the flash light-emitting diode LED1 and duty circles of pulse signals for controlling the first switch K1 and the third switch K3 respectively.

In an embodiment, when the inductor L1 and the capacitor C1 operate at a boost mode, the control unit 110 determines whether to switch the operating modes of the inductor L1 and the capacitor C1 to the buck mode according to the first driving current ID1 and the duty circle of the pulse signal for controlling the third switch K3. When the inductor L1 and the capacitor C1 operate at a buck mode, the control unit 110 determines whether to switch the operating modes of the inductor L1 and the capacitor C1 to the boost mode according to the first driving current ID1 and the duty circle of the pulse signal for controlling the first switch K1.

In embodiments, the inductor and the capacitor are controlled to operate at a buck mode (i.e., the inductor and the capacitor serve as a buck circuit) or a boost mode (i.e., the inductor and the capacitor serve as a boost circuit). The driving circuit is improved due to the high efficient buck circuit.

In the embodiment, the control unit 110 includes a mode determining unit 111, a buck control unit 112, a boost control unit 113, a current sensor 114 (corresponding to a first current sensor), a first determining unit 115, a first switching unit 116, a second determining unit 117 and a second switching unit 118.

The mode determining unit 111 is coupled to the buck control unit 112 and the boost control unit 113. The mode determining unit 111 determines the driving mode of the flash light-emitting diode LED1 to enable the buck control unit 112 or the boost control unit 113. In an embodiment, the driving circuit 100 is applied to an electronic device with a CPU, the mode determining unit 111 determines the driving mode of the flash light-emitting diode LED1 according to a corresponding application program executed by the CPU.

In an embodiment, when the CPU runs a lighting application (or torch application), the mode determining unit 111 determines that the driving mode of the flash light-emitting diode LED1 is a torch mode. In an embodiment, when the CPU runs a camera application, the mode determining unit 111 determines that the driving mode of the flash light-emitting diode LED1 is a flash mode.

The buck control unit 112 is coupled to the first switch K1 and the second switch K2 to turn on/off the first switch K1 and the second switch K2. In the embodiment, when the buck control unit 112 is enabled, the first switch K1 and the second switch K2 are turned on and off alternatively, the third switch K3 is turned on and the fourth switch K4 is turned off, and then the inductor L1 and the capacitor C1 operate as the buck circuit. The buck control unit 112 provides a driving signal (i.e., a first pulse signal SP1) for the first switch K1 to the first determining unit 115. When the buck control unit 112 is disabled, the first switch K1 maintains the conduction (ON), the second switch K2 maintains off and the buck control unit 112 stops providing the first pulse signal SP1.

The boost control unit 113 is coupled to the third switch K3 and the fourth switch K4 to turn on/off the third switch K3 and the fourth switch K4. In an embodiment, when the boost control unit 113 is enabled, the first switch K1 is turned on, the second switch K2 is turned off, the third switch K3 and the fourth switch K4 are turned on/off alternatively, and then the inductor L1 and the capacitor C1 operate as the boost circuit. The boost control unit 113 provides a driving signal (i.e., a second pulse signal SP2) for the third switch K3 to the second determining unit 117. When the boost control unit 113 is disabled, the third switch K3 maintains the conduction (ON), the fourth switch K4 maintains off, and the boost control unit 113 stops providing the second pulse signal SP2.

The current sensor 114 is used for detecting the first driving current ID1 flowing through the flash light-emitting diode LED1 to provide a first current signal SI1 to the first determining unit 115 and the second determining unit 117. The first determining unit 115 is coupled to the buck control unit 112 and the current sensor 114. The first determining unit 115 provides a first determining signal SDT1 according to the duty circle of the first pulse signal SP1 and the first current signal SI1. The first switching unit 116 is coupled to the buck control unit 112, the boost control unit 113, and the first determining unit 115 to determine whether to disable the buck control unit 112 and enable the boost control unit 113 according to the first determining signal SDT1.

The second determining unit 117 is coupled to the boost control unit 113 and the current sensor 114 to provide a second determining signal SDT2 according to the duty circle of the second pulse signal SP2 and the first current signal SI1. The second switching unit 118 is coupled to the buck control unit 112, the boost control unit 113 and the second determining unit 117 to determine whether to disable the boost control unit 113 and enable the buck control unit 112 according to the second determining signal SDT2.

In an embodiment, when the driving mode of the flash light-emitting diode LED1 is a torch mode, the mode determining unit 111 enables the buck control unit 112 and disables the boost control unit 113. After the buck control unit 112 is enabled and operates stably (for example, after 5 milliseconds), the second determining unit 117 is disabled and the first determining unit 115 determines whether the duty circle of the first pulse signal SP1 is equal to the maximum duty circle (for example, 100%) and whether the first driving current ID1 is less than a first setting current.

In an embodiment, when the buck control unit 112 is enabled, the duty circle of the first pulse signal SP1 is equal to the maximum duty circle and the first driving current ID1 is less than the first setting current, that means, the buck circuit cannot provide sufficient power to the flash light-emitting diode LED1. In this case, the first switching unit 116 enables the boost control unit 113 and disables the buck control unit 112. In another embodiment, when the buck control unit 112 is enabled, the duty circle of the first pulse signal SP1 is less than the maximum duty circle (for example, 100%) and the first driving current ID1 is greater than or equal to the first setting current, that means, the buck circuit provides sufficient power to the flash light-emitting diode LED1. In this case, the first switching unit 116 maintains the disablement of the boost control unit 113 and the enablement of the buck control unit 112.

On the other hand, when the driving mode of the flash light-emitting diode LED1 is a flash mode, the mode determining unit 111 enables the boost control unit 113 and disables the buck control unit 112. After the boost control unit 113 is enabled and operates stably (for example, after 5 milliseconds), the first determining unit 115 is disabled and the second determining unit 117 determines whether the duty circle of the second pulse signal SP2 is equal to or less than the minimum duty circle (for example, 10%) and whether the first driving current DI1 is larger than a second setting current.

When the boost control unit 113 is enabled, the duty circle of the second pulse signal SP2 is equal to or less than the minimum duty circle and the first driving current ID1 is greater than the second setting current, the boost circuit provides an excessive power to the flash light-emitting diode LED1. In this case, the second switching unit 118 enables the buck control unit 112 and disables the boost control unit 113. When the boost control unit 113 is enabled, the duty circle of the second pulse signal SP2 is greater than the minimum duty circle and the first driving current ID1 is equal to or less than the second setting current, the boost circuit provides a proper power to the flash light-emitting diode LED1. In this case, the second switching unit 118 maintains the disablement of the buck control unit 112 and the enablement of the boost control unit 113.

In an embodiment, the first setting current is the same as the second setting current. In another embodiment, the first setting current and the second setting current are set differently according to the circuit design requirement or a current default setting of the application program, which is not limited herein.

Figure 2:
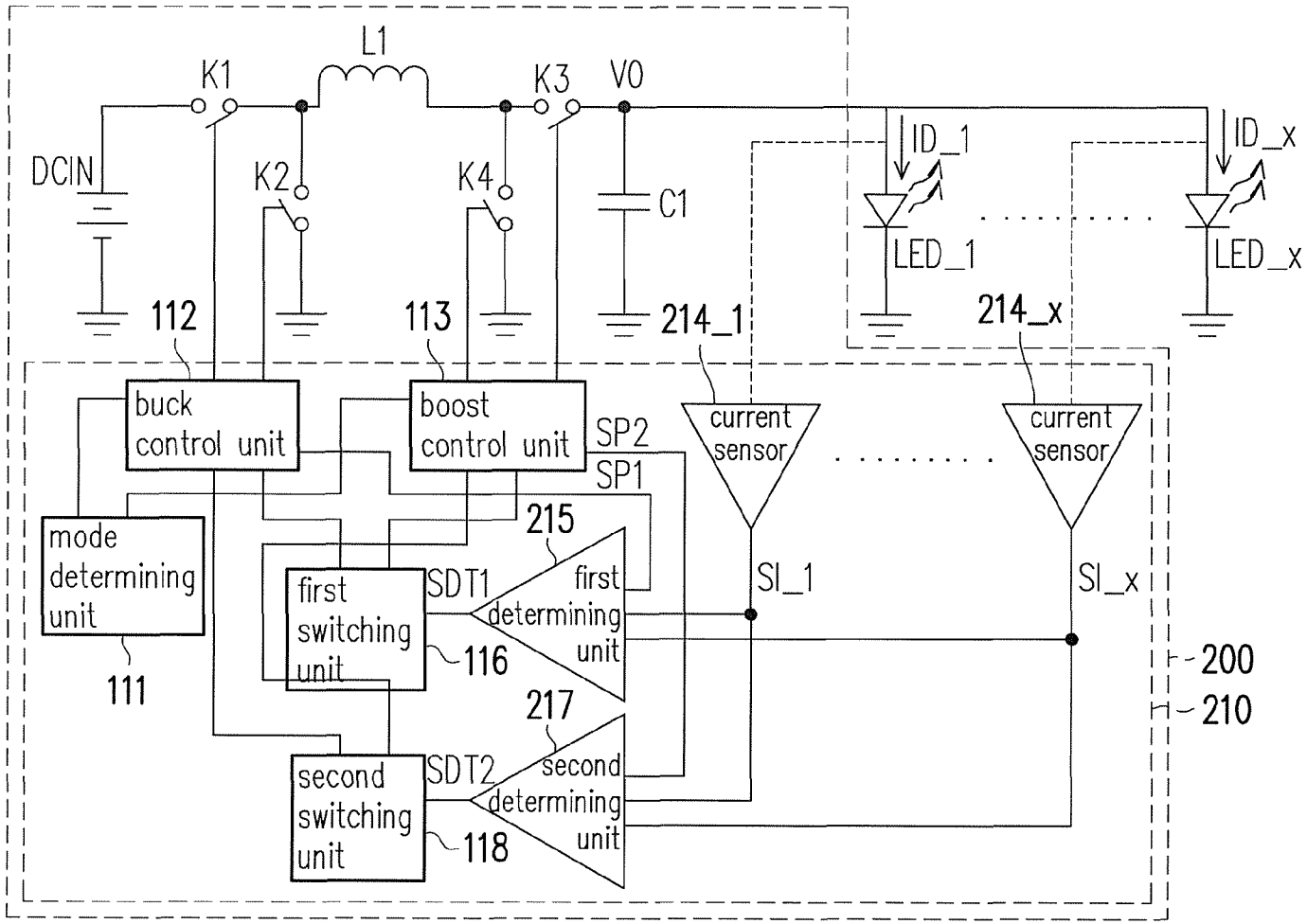
FIG. 2 is a circuit schematic diagram showing a driving circuit for a flash light-emitting diode in an embodiment.

FIG. 2 is a circuit schematic diagram showing a driving circuit for a flash light-emitting diode in an embodiment. In FIG. 1 and FIG. 2, the same or similar reference number denotes the same or similar component. Referring to FIG. 1 and FIG. 2, the difference between the driving circuit 200 for the flash light-emitting diode and the driving circuit 100 for the flash light-emitting diode is that the driving circuit 200 provides the driving voltage VO to multiple flash light-emitting diodes LED_1~LED_x (corresponding to a first and a second flash light-emitting diodes) connected in parallel, wherein x represents a positive integer greater than two.

In a control unit 210, multiple current sensors 214_1~214_*x* are configured correspondingly to detect multiple driving currents ID_1~ID_x flowing through the flash light-emitting diodes LED_1~LED_x, respectively, to provide multiple current signals SI_1~SI_x (corresponding to a first current signal and a second current signal) to a first determining unit 215 and a second determining unit 217.

After the first determining unit 215 receives the current signals SI_1~SI_x, the first determining unit 215 compares a total current of the driving currents ID_1~ID_x with a first setting current to provide a first determining signal SDT1. Similarly, after the second determining unit 217 receives the current signals SI_1~SI_x, the second determining unit 217 compares a total current of the driving currents ID_1~ID_x with a second setting current to provide a second determining signal SDT2.

In other words, when the buck control unit 112 is enabled, the duty circle of the first pulse signal SP1 is equal to the maximum duty circle and the total current of the driving currents ID_1~ID_x is less than the first setting current, the first switching unit 116 enables the boost control unit 113 and disables the buck control unit 112. When the duty circle of the first pulse signal SP1 is less than the maximum duty circle (for example, 100%) and the total current of the driving currents ID_1~ID_x is greater than or equal to the first setting current, the first switching unit 116 maintains the disablement of the boost control unit 113 and the enablement of the buck control unit 112 when the buck control unit 112 is enabled.

In the embodiment, when the boost control unit 113 is enabled, the duty circle of the second pulse signal SP2 is equal to or less than the minimum duty circle and the total current of the driving currents ID_1~ID_x is greater than the second setting current, the second switching unit 118 enables the buck control unit 112 and disables the boost control unit 113. When the boost control unit 113 is enabled, the duty circle of the second pulse signal SP2 is greater than the minimum duty circle and the total current of the driving currents ID_1~ID_x is less than or equal to the second setting current, the second switching unit 118 maintains the disablement of the buck control unit 112 and the enablement of the boost control unit 113.

Figure 3:
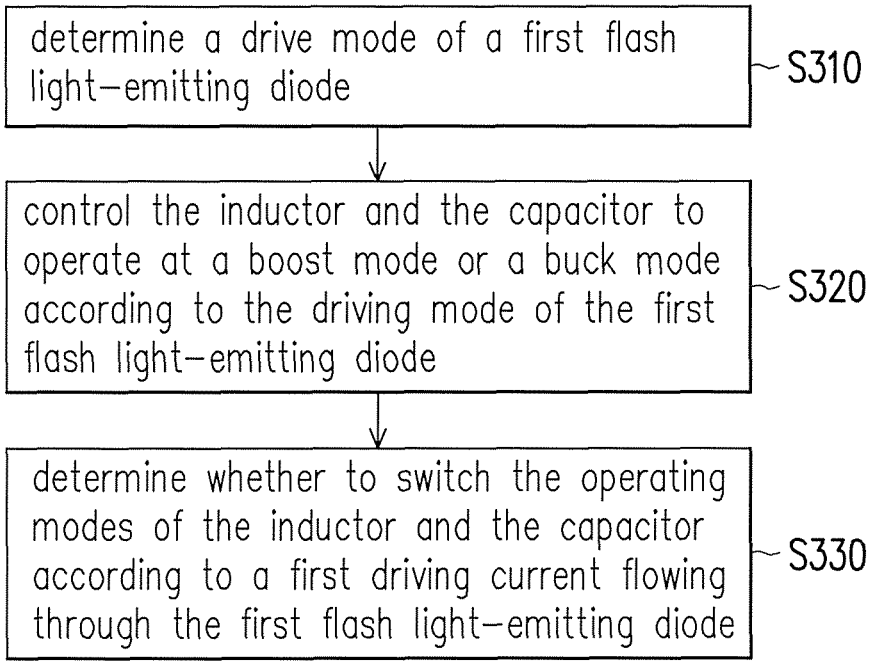
FIG. 3 is a flow chart showing an operating method of a driving circuit for a flash light-emitting diode in an embodiment.

FIG. 3 is a flow chart showing an operating method of a driving circuit for a flash light-emitting diode in an embodiment. Referring to FIG. 3, in the embodiment, an operating method of a driving circuit for a flash light-emitting diode includes the following steps. In step S310, a driving mode of the first flash light-emitting diode is determined. The inductor and the capacitor are controlled to operate at a boost mode or a buck mode according to the driving mode of the first flash light-emitting diode (step S320) and whether to switch the operating modes of the inductor and the capacitor is determined according to a first driving current flowing through the first flash light-emitting diode (step S330).

Figure 4:
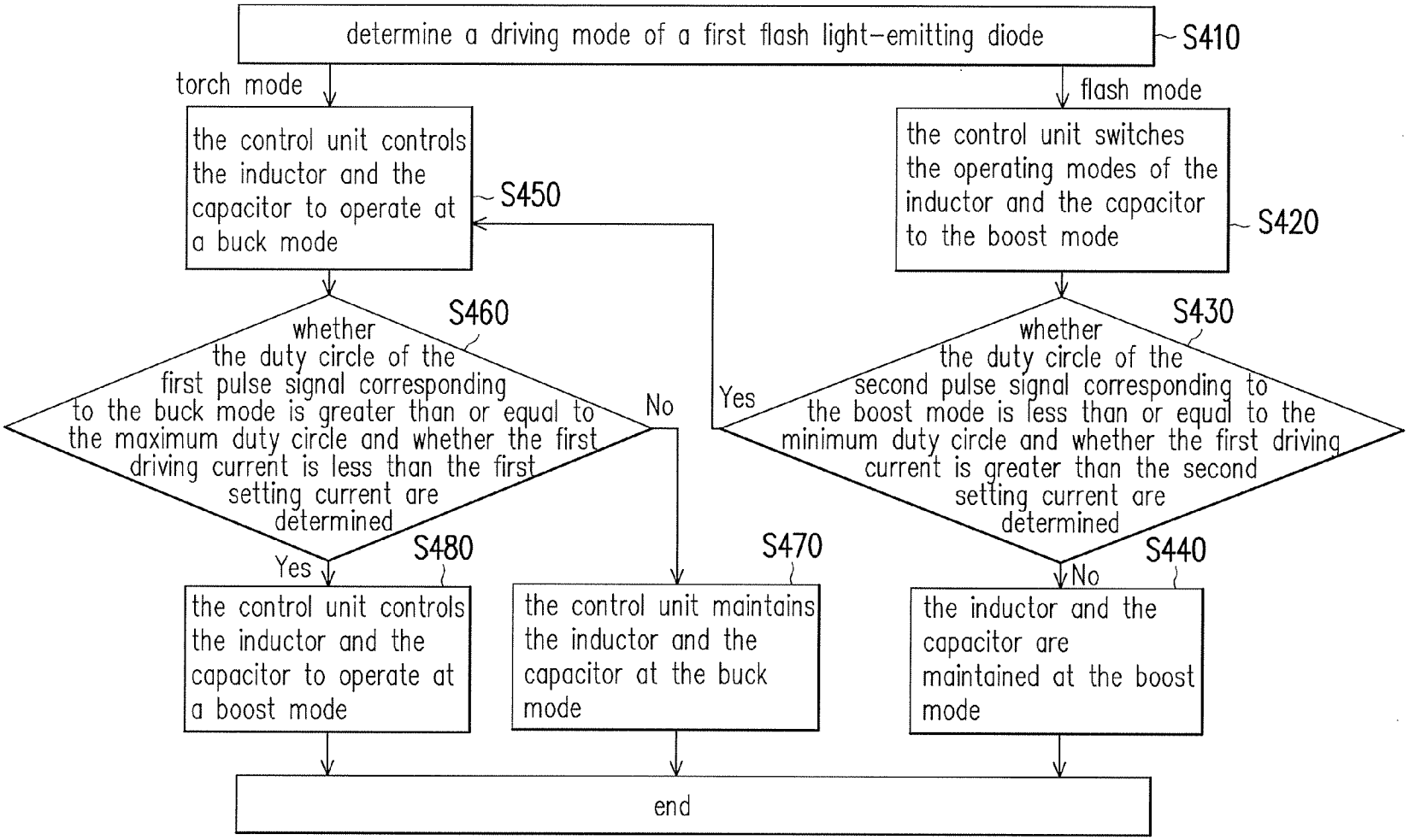
FIG. 4 is a flow chart showing an operating method of a driving circuit for a flash light-emitting diode in an embodiment.

FIG. 4 is a flow chart showing an operating method of a driving circuit for a flash light-emitting diode in an embodiment. Referring to FIG. 4, in the embodiment, an operating method of a driving circuit for a flash light-emitting diode includes the following steps. In step S410, a driving mode of the first flash light-emitting diode is determined. When the driving mode of the first flash light-emitting diode is a torch mode, the control unit controls the inductor and the capacitor to operate at a buck mode (step S450).

Then, whether the duty circle of the first pulse signal corresponding to the buck mode is greater than or equal to the maximum duty circle and whether the first driving current is less than the first setting current are determined (step S460). The control unit controls the inductor and the capacitor to operate at a boost mode when the duty circle of the first pulse signal is greater than the maximum duty circle and the first driving current is less than the first setting current (the determining result of the step S460 is "YES") (step S480). The control unit maintains the inductor and the capacitor at the buck mode when the duty circle of the first pulse signal is less than the maximum duty circle or the first driving current is greater than or equal to the first setting current (i.e., the result of the step S460 is "NO") (step S470).

Back to step S410, when the driving mode of the first flash light-emitting diode is a flash mode, the control unit switches the operating modes of the inductor and the capacitor to the boost mode (step S420). Then, whether the duty circle of the second pulse signal corresponding to the boost mode is less than or equal to the minimum duty circle and whether the first driving current is greater than the second setting current are determined (step S430).

When the duty circle of the second pulse signal corresponding to the boost mode is less than the minimum duty circle and the first driving current is greater than the second setting current (i.e., the determining result of the step S430 is "YES"), then step S450 is executed. The inductor and the capacitor are maintained at the boost mode when the duty circle of the second pulse signal corresponding to the boost mode is greater than the minimum duty circle or the first driving current is less than or equal to the second setting current (i.e., the determining result of the step S430 is "NO") (step S440).

In the embodiment, the sequence of the steps S310, S320, S330, S410, S420, S430, S440, S450, S460, S470 and S480 is exemplified only for illustration, which is not limited herein. Details for the steps S310, S320, S330, S410, S420, S430, S440, S450, S460, S470 and S480 can refer to the embodiments of FIG. 1 and FIG. 2, which is omitted herein.

In sum, in the embodiments, whether the inductor and the capacitor operate as the buck circuit or the boost circuit is determined according to the driving mode of the flash light-emitting diode. Furthermore, whether to switch the operating modes of the inductor and the capacitor is determined according to the first pulse signal corresponding to the buck circuit, the second pulse signal corresponding to the boost circuit and the driving current flowing through the flash light-emitting diode. In such a way, the driving circuit is improved due to the high efficient of the buck circuit.

Although the disclosure includes been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. A driving circuit for providing a driving voltage to a first flash light-emitting diode, comprising:

an inductor;

a first switch coupled between an input voltage and a first end of the inductor;

a second switch coupled between the first end of the inductor and a ground voltage;

a capacitor, wherein a first end of the capacitor provides the driving voltage, and a second end of the capacitor is coupled to the ground voltage;

a third switch coupled between a second end of the inductor and the first end of the capacitor;

a fourth switch coupled between the second end of the inductor and the ground voltage; and a control unit coupled to the first switch, the second switch, the third switch and the fourth switch, wherein the control unit controls the inductor and the capacitor to operate at a boost mode or a buck mode according to a driving mode of the first flash light-emitting diode, detects a first driving current flowing through the first flash light-emitting diode, and determines whether to switch the operating modes of the inductor and the capacitor according to the first driving current flowing through the first flash light-emitting diode, wherein the control unit includes:

a buck control unit coupled to the first switch and the second switch to turn on or off the first switch and the second switch and providing a first pulse signal corresponding to the first switch;

a boost control unit coupled to the third switch and the fourth switch to turn on or off the third switch and the fourth switch and providing a second pulse signal corresponding to the third switch; and a mode determining unit coupled to the buck control unit and the boost control unit, wherein the mode determining unit determines the driving mode of the first flash light-emitting diode to enable one of the buck control unit and the boost control unit and to disable another of the buck control unit and the boost control unit.

2. The driving circuit according to claim 1, wherein the control unit further includes:

a first current sensor for sensing the first driving current flowing through the first flash light-emitting diode to provide a first current signal;

a first determining unit coupled to the buck control unit and the first current sensor to provide a first determining signal according to a duty circle of the first pulse signal and the first current signal;

a first switching unit coupled to the buck control unit, the boost control unit and the first determining unit to determine whether to disable the buck control unit and whether to enable the boost control unit according to the first determining signal; and a second determining unit coupled to the boost control unit and the first current sensor to provide a second determining signal according to a duty circle of the second pulse signal and the first current signal; and a second switching unit coupled to the buck control unit, the boost control unit and the second determining unit to determine whether to disable the boost control unit and whether to enable the buck control unit according to the second determining signal.

3. The driving circuit according to claim 2, wherein the mode determining unit enables the buck control unit and disables the boost control unit when the driving mode is a torch mode, and the mode determining unit enables the boost control unit and disables the buck control unit when the driving mode is a flash mode.

4. The driving circuit according to claim 3, wherein when the buck control unit is enabled, the duty circle of the first pulse signal is a maximum duty circle and the first driving current is less than a first setting current, the first switching unit enables the boost control unit and disables the buck control unit.

5. The driving circuit according to claim 3, wherein when the boost control unit is enabled, the duty circle of the second pulse signal is less than or equal to a minimum duty circle and the first driving current is greater than a second setting current, the second switching unit enables the buck control unit and disables the boost control unit.

6. The driving circuit according to claim 3, wherein the driving circuit provides the driving voltage to a second flash light-emitting diode, and the driving circuit further includes a second current sensor for sensing a second driving current flowing through the second flash light-emitting diode and providing a second current signal to the first determining unit and the second determining unit.

7. The driving circuit according to claim 6, wherein when the buck control unit is enabled, the duty circle of the first pulse signal is equal to the maximum duty circle and a total current of the first driving current and the second driving current is less than the first setting current, the first switching unit enables the boost control unit and disables the buck control unit.

8. The driving circuit according to claim 6, wherein when the boost control unit is enabled, the duty circle of the second pulse signal is less than or equal to the minimum duty circle and a total current of the first driving current and the second driving current is greater than the second setting current, the second switching unit enables the buck control unit and disables the boost control unit.

9. An operating method of a driving circuit for driving a first flash light-emitting diode, the driving circuit includes an inductor and a capacitor, the operating method comprising:

determining a driving mode of a first flash light-emitting diode;

controlling operating modes of the inductor and the capacitor according to the driving mode of the first flash light-emitting diode, the step of controlling the operating modes of the inductor and the capacitor includes:

controlling the inductor and the capacitor to operate at a buck mode when the driving mode of the first flash light-emitting diode is a torch mode; and controlling the inductor and the capacitor to operate at a boost mode when the driving mode of the first flash light-emitting diode is a flash mode;

detecting a first driving current flowing through the first flash light-emitting diode; and determining whether to switch the operating modes of the inductor and the capacitor according to the first driving current flowing through the first flash light-emitting diode.

10. The operating method of the driving circuit for driving the first flash light-emitting diode according to claim 9, wherein the step of determining whether to switch the operating modes of the inductor and the capacitor according to the first driving current flowing through the first flash light-emitting diode includes:

switching the operating modes of the inductor and the capacitor to the boost mode when the inductor and the capacitor are at the buck mode, a duty circle of a first pulse signal corresponding to the buck mode is equal to a maximum duty circle and the first driving current is less than a first setting current; and maintaining the inductor and the capacitor at the buck mode when the inductor and the capacitor are at the buck mode and the duty circle of the first pulse signal corresponding to the buck mode is less than the maximum duty circle, or the first driving current is equal to or greater than the first setting current.

11. The operating method of the driving circuit for driving the first flash light-emitting diode according to claim 9, wherein the step of determining whether to switch the operating modes of the inductor and the capacitor according to the first driving current flowing through the first flash light-emitting diode includes:

switching the operating mode of the inductor and the capacitor to the buck mode when the inductor and the capacitor are at the boost mode, a duty circle of a second pulse signal corresponding to the boost mode is equal to or less than a minimum duty circle and the first driving current is greater than a second setting current; and maintaining the inductor and the capacitor at the boost mode when the operating modes of the inductor and the capacitor are the boost mode, the duty circle of the second pulse signal corresponding to the boost mode is greater than the minimum duty circle or the first driving current is equal to or less than the second setting current.

12. The operating method of the driving circuit for driving the first flash light-emitting diode according to claim 9, wherein the driving circuit is used for providing the driving voltage to a second flash light-emitting diode, and the step of determining whether to switch the operating modes of the inductor and the capacitor according to the first driving current flowing through the first flash light-emitting diode includes:

switching the operating modes of the inductor and the capacitor to the boost mode when the inductor and the capacitor are at the buck mode, a duty circle of a first pulse signal corresponding to the buck mode is equal to a maximum duty circle and a total current of the first driving current and the second driving current flowing through the second flash light-emitting diode is less than a first setting current; and maintaining the inductor and the capacitor at the buck mode when the inductor and the capacitor are at the buck mode and the duty circle of the first pulse signal corresponding to the buck mode is less than the maximum duty circle or the total current is equal to or greater than the first setting current.

13. The operating method of the driving circuit for driving the first flash light-emitting diode according to claim 9, wherein the driving circuit is used for providing the driving voltage to a second flash light-emitting diode, and the step of determining whether to switch the operating modes of the inductor and the capacitor according to the first driving current flowing through the first flash light-emitting diode includes:

switching the operating modes of the inductor and the capacitor to the buck mode when the inductor and the capacitor are at the boost mode, a duty circle of a second pulse signal corresponding to the boost mode is less than or equal to a minimum duty circle and a total current of the first driving current and second driving current flowing through the second flash light-emitting diode is greater than a second setting current; and maintaining the inductor and the capacitor at the boost mode when the inductor and the capacitor are at the boost mode and the duty circle of the second pulse signal corresponding to the boost mode is greater than the minimum duty circle or the total current is less than or equal to the second setting current.

* * * * *